United States Patent [19]

Bowser, Sr. et al.

[11] Patent Number: 4,838,176

[45] Date of Patent: Jun. 13, 1989

[54] NESTING AND STACKING PALLET

[75] Inventors: Harold R. Bowser, Sr.; Monty C. Chapman, Jr., both of Jacksonville, Fla.

[73] Assignee: Bowser Pallet Co., Jacksonville, Fla.

[21] Appl. No.: 235,647

[22] Filed: Aug. 24, 1988

[51] Int. Cl.[4] ..... B65D 19/04

[52] U.S. Cl. ..... 108/53.3; 108/901

[58] Field of Search ..... 108/51.1, 53.3, 901

[56] References Cited

U.S. PATENT DOCUMENTS

| | | | |
|---|---|---|---|
| Re. 32,344 | 2/1987 | Wind . | |
| 2,544,657 | 3/1951 | Cushman | 108/53.3 |
| 2,916,239 | 12/1959 | Stopps . | |
| 2,973,931 | 3/1961 | Brown | 108/53.3 |
| 3,140,672 | 7/1964 | de Luca . | |
| 3,187,691 | 6/1965 | Leitzel | 108/53.3 |
| 3,590,751 | 7/1971 | Freid et al. . | |
| 3,680,495 | 8/1972 | Pike | 108/53.3 |
| 3,702,100 | 11/1972 | Wharton | 108/53.3 |
| 3,762,342 | 10/1973 | Lawlor | 108/53.3 |
| 3,948,190 | 4/1976 | Cook, III et al. . | |
| 3,964,400 | 6/1976 | Brand . | |
| 4,000,704 | 1/1977 | Griffin, Jr. . | |
| 4,013,021 | 3/1977 | Steinlein et al. . | |
| 4,133,270 | 1/1979 | Ravera . | |
| 4,254,873 | 3/1981 | Cook, III et al. . | |
| 4,263,855 | 4/1981 | Lawlor . | |
| 4,290,369 | 9/1981 | Propst et al. . | |
| 4,316,419 | 2/1982 | Cupido . | |
| 4,403,555 | 9/1983 | Forrest | 108/901 X |
| 4,413,737 | 11/1983 | Wind | 108/53.3 |
| 4,478,156 | 10/1984 | Andersson . | |
| 4,480,748 | 11/1984 | Wind . | |
| 4,562,718 | 1/1986 | Dunk . | |
| 4,580,680 | 4/1986 | Wind . | |

*Primary Examiner*—Peter A. Aschenbrenner

[57] ABSTRACT

A unitary load carrying pallet of rigid plastic foam material includes a rectangular base having a top planar loading surface and a lower surface and four side walls meeting in corners to form a rectangular structure. A functional rectangular section is placed in each of the four corners of the pallet, one section along each side wall generally midway between the corners, and at least one section substantially centrally of the pallet. Each section includes an upper surface coplanar with the loading surface and having a plurality of closely spaced recesses extending downwardly from the loading surface and terminating in a bottom spaced above the lower surface of the base. Each section also includes a plurality of hollow tubular legs conforming to and extending below the recesses and aligned so as to permit the legs of one pallet to freely slide into the corresponding recesses of a second pallet to form a nesting pair of pallets with the bottom surface of the upper pallet being supported by the top loading surface of the lower pallet. The nestable arrangement of recesses and legs become nonnestable and stackable upon rotation of alternate pallets 180° about a vertical axis perpendicular to the loading surface.

25 Claims, 6 Drawing Sheets

NESTING AND STACKING PALLET

BACKGROUND OF THE INVENTION

Pallets have been used for many years as a supporting surface for a wide variety of goods that are packaged in separate small units. Each pallet serves to support several small unit packages that may be strapped to the pallet to form a large transportable unit for loading into a truck, a train, a ship, an airplane or the like. Generally pallets have been made of wood pieces nailed together so that a fork lift truck can lift a pallet on the fork and move it from place to place. Wooden pallets are heavy, easily broken, and not nestable; and accordingly there have been many efforts made to design plastic molded pallets which can serve the same purposes as the wooden pallets and do so with less problems and more convenience. In some instances the pallets have been made to be interlocking such that a pallet on top of one load will nest with a pallet on the bottom of the next load for the purpose of making a more stable stack of loaded pallets. In other instances pallets have been made nestable so as to save space when shipping empty pallets. In still other instances pallets have been designed so as to be nestable when oriented in one direction and nonnestable when oriented in another direction. Such combinations of nestable and stackable or nonnestable trays or large open top containers are shown in U.S. Pat. Nos. 2,916,239; 2,973,931; 3,702,100; 3,590,751; and 3,964,400. Insofar as is known such selective stackable and nestable features, as well as other features herein, are not found in pallets of the prior art.

It is an object of this invention to provide a novel pallet of molded, foamed, rigid, synthetic plastic which is selectively nestable or stackable. It is another object of this invention to provide a pallet with the selected functions achieved by merely orienting adjoining pallets by rotating them about a vertical axis to provide the desired function. A further object is to provide foamed plastic pallet having enhanced strength characteristics while providing a minimum of weight as well as being selectively nestable and stackable and capable of being dispensed in either horizontal lateral direction from a stack thereof. Still other objects will become apparent from the more detailed description which follows.

BRIEF SUMMARY OF THE INVENTION

This invention relates to a load carrying unitary rectangular pallet made of a rigid molded synthetic plastic foam having a planar top loading surface, a bottom surface, parallel to the top surface, and four substantially vertical side walls depending downwardly from the top surface to the bottom surface and meeting in four right angle corners. A plurality of spaced geometrically shaped functional sections are provided in the base and have top surfaces coplanar with the top loading surface and vertical walls extending downwardly from the top loading surface to a bottom of the recess. Four of the sections are located in the four right angle corners, four other sections are located along the side walls generally midway between adjacent pairs of the four right angle corners, and at least one of the sections spaced away from the side walls and positioned to permit unobstructed insertion of the tines of a fork lift truck under the bottom surface. Each of the sections has a recess extending downwardly from the top loading surface to a bottom spaced surface above the bottom of the base. Each recess has a hollow tubular leg extending in substantial vertical alignment with the corresponding recess from the bottom of the recess to a distance not greater than the vertical height of the recess and being of a size and shape in outside dimensions of the leg so as to freely fit telescopically into a corresponding recess of a pallet positioned therebelow. The base between the recesses being filled with a plurality of spaced intersecting vertical parallel stiffening webs extending between the side walls at an acute angle and across all open portions of said base from the top loading surface to the bottom surface with the intersecting webs forming a honeycomb structure.

In preferred embodiments of the invention the pallet has nine functional sections and is convertible from a nestable article to a stackable (nonnestable) article by placing the functional sections in a nonsymmetrical arrangement and/or by making some of the sections of a different size and shape from others of the sections so that the pallet legs of one pallet will nest in the recesses of another pallet when both are oriented in the same direction, but will not nest when one pallet is rotated 180° horizontally around an axis perpendicular to the top loading surface with respect to the other pallet. Also, a minimum of foamed plastic is used while providing for maximum strength and durability to the pallet by also providing webs in the hollow legs and which further distribute the forces of the load onto a support surface.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE PREFERRED EMBODIMENTS OF THE INVENTION

Figure 1:
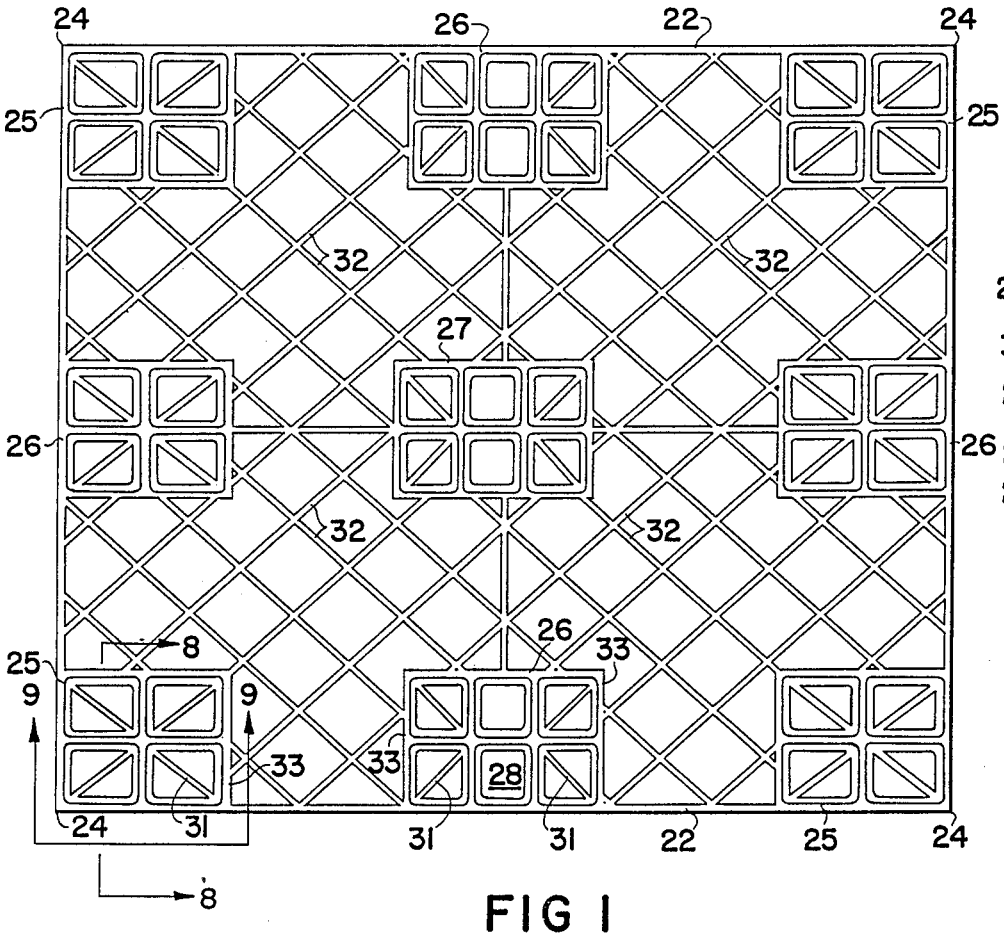
FIG. 1 is a top plan view of one embodiment of a pallet according to this invention.
Figure 3:
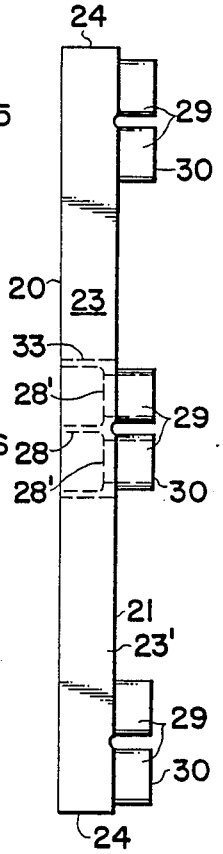
FIG. 3 is a right side elevational view of the pallet of FIG. 1.
Figure 2:
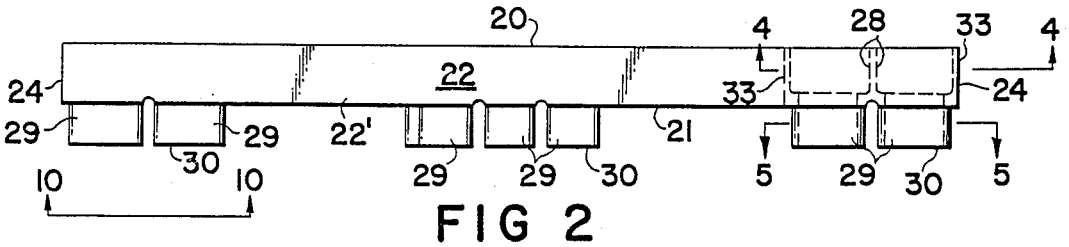
FIG. 2 is a front elevational view of the pallet of FIG. 1.
Figure 7:
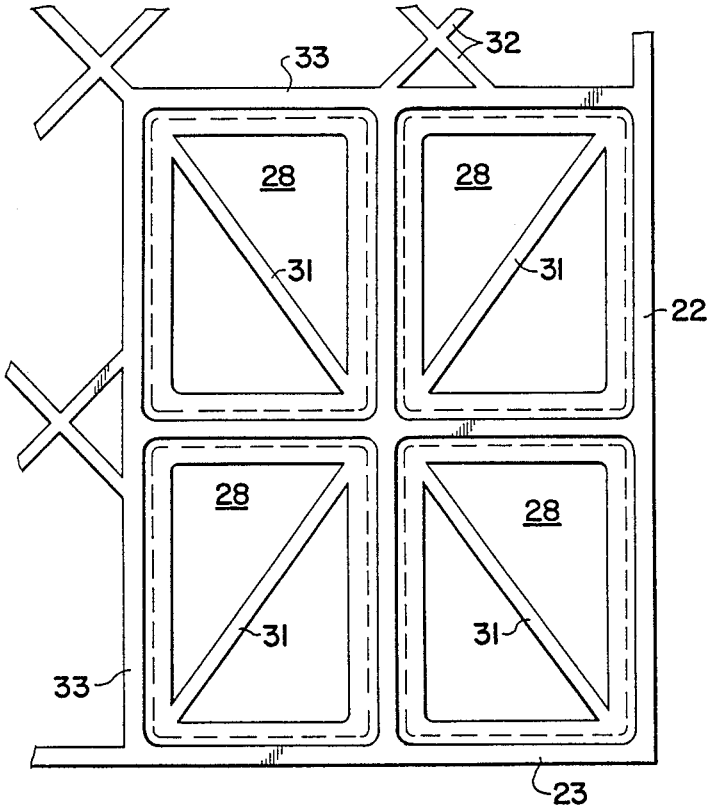
FIG. 7 is an enlarged top plan view of one corner of the pallet of FIG. 1.
Figure 4:
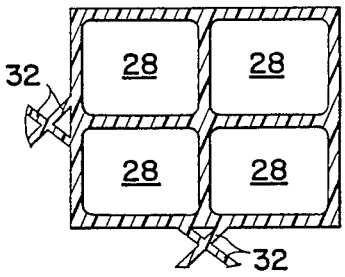
FIG. 4 is a cross sectional view taken along line 4—4 of FIG. 1.
Figure 5:
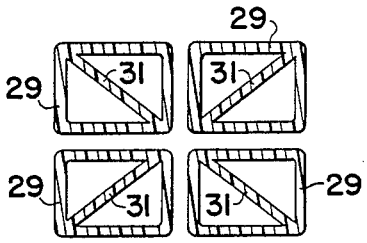
FIG. 5 is a cross sectional view taken along line 5—5 of FIG. 1.

The general features of this invention may best be understood by reference to the accompanying drawings in the following description. FIGS. 1–12 refer particularly to the structure of the pallet of this invention.

The pallet of this invention is a rectangular supporting platform which can rest on the ground with a load of goods stacked on the pallet and spaces underneath the pallet for the tines of a fork lift truck to be inserted from either side or either end for lifting the pallet and its load of goods and transporting the total to another location.

As noted above the pallet is a rectangular structure having a planar top loading surface 20, a bottom surface 21, which preferably, but not necessarily, is also planar and parallel to top loading surface 20. Surfaces 20 and 21 are bound by four side walls, including two longitudinal side walls 22 and two lateral side walls 23 meeting in four right angle corners 24. Longitudinal side walls 22 are somewhat longer than lateral side walls 23; longitudinal walls preferably being about 48 inches long and lateral walls being about 40 inches long. The distance between top loading surface 20 and bottom surface 21 should be about 3.25 inches.

Within the side walls 22 and 23 is a space in which a plurality of (preferably nine) functional sections are positioned with the remaining space filled with a honeycomb structure of vertical webs 32 intersecting each other at substantially right angles, with each web 32 being placed at an angle of about 45° from side walls 22 and 23. Webs 32 forming the honeycomb structure provide a pallet of structural integrity and enhanced load carrying ability to the pallet. It is, of course, entirely operational for the webs 32 to be oriented at differing angles from side walls 22 and 23, and, for example, the honeycomb structure could be provided by other geometric cross sectional shapes like a circle.

The functional sections include four corner sections 23, four side sections 26, and one or more center section 27. These sections 25, 26 and 27 provide the capability for the pallet to nest with another pallet or not to nest with another pallet, but rather to be able to stack one on top of another. Each of the sections 25, 26 and 27 contains a plurality of recesses 28 and a tubular leg 29 projecting downwardly from each recess 28. Bottom surface 30 of legs 29 is planar and supports the pallet from the floor or from another pallet or some other surface. The distance from bottom surface 21 to bottom surface 30 is preferably about 2.5 inches, which is sufficient to permit the tines of a fork lift truck to be inserted under bottom surface 21.

Recesses 28 in sections 25, 26 and 27 are generally rectangular in cross section (taken parallel to top loading surface 20) with an open top at loading surface 20, and extending vertically downwardly to legs 29. The bottom of recess 28 and the top of legs 29 are substantially at the level of bottom surface 21. Legs 29 are also rectangular in cross section (taken parallel to top loading surface 20) and that cross section is offset inwardly from the upper portion 22′ and 23′ of walls 22 and 23 and of a size to easily slide into a recess 28 from another pallet in a male-female connection. When legs 29 of one pallet fit into recesses 28 of another pallet, the two pallets are in a nesting arrangement.

As may be seen in the drawings, the arrangement of sections 25, 26 and 27 is such that sections 25 are in corners 24 sharing portions of side walls 22 and 23 to define sections 25. The two remaining walls 33 define the rectanular shape of section 25 to contain four recesses 28 and four legs 29 arranged in two rows of two each. Approximately midway between adjacent corner sections 25 are side sections 26 sharing a portion of side wall 22 or 23 and three walls 33 to define each section 26. The two side sections 26 along lateral side wall 23 are identical in structure to corner sections 25. The two side sections 26 along longitudinal side wall 22 and center section 27 contain six recesses 28 and legs 29 arranged in two rows of three each. Each of the six portions contains a recess 28 opening at the loading surface 20 and a leg 29 depending below recess 28. Leg portions 29 of any of sections 25, 26 and 27 also contains stiffening webs 31 extending diagonally across the cross section from one corner to the other (see FIG. 5), and extending vertically from the bottom 28′ of recess 28 to bottom surface 30.

In order to provide the selective capability of nesting some of sections 25, 26 and 27 are offset toward or away from any one of side walls 22 and 23. In FIG. 1 center section 27 is offset to the left from alignment with either of side sections 26 along side walls 22. Thus, if two pallets with offset sections 27 will nest (i.e., legs 29 of upper pallet will slide into recess 28 of lower pallet), then both pallets are oriented in the same direction. However, if one pallet is rotated horizontally 180° about a vertical axis perpendicular to loading surface 20 there will be no nesting of legs 29 on upper pallet into recesses 28 of a lower pallet because of the offset of section 27. As will be apparent it makes no difference which way the offset is made, the same result is achieved, i.e., nestable pallets if all pallets are oriented in the same direction, and nonnestable pallets if adjacent pallets are oriented 180° different. It is to be understood that some of the other sections could be similarly offset if desired.

Figure 6:
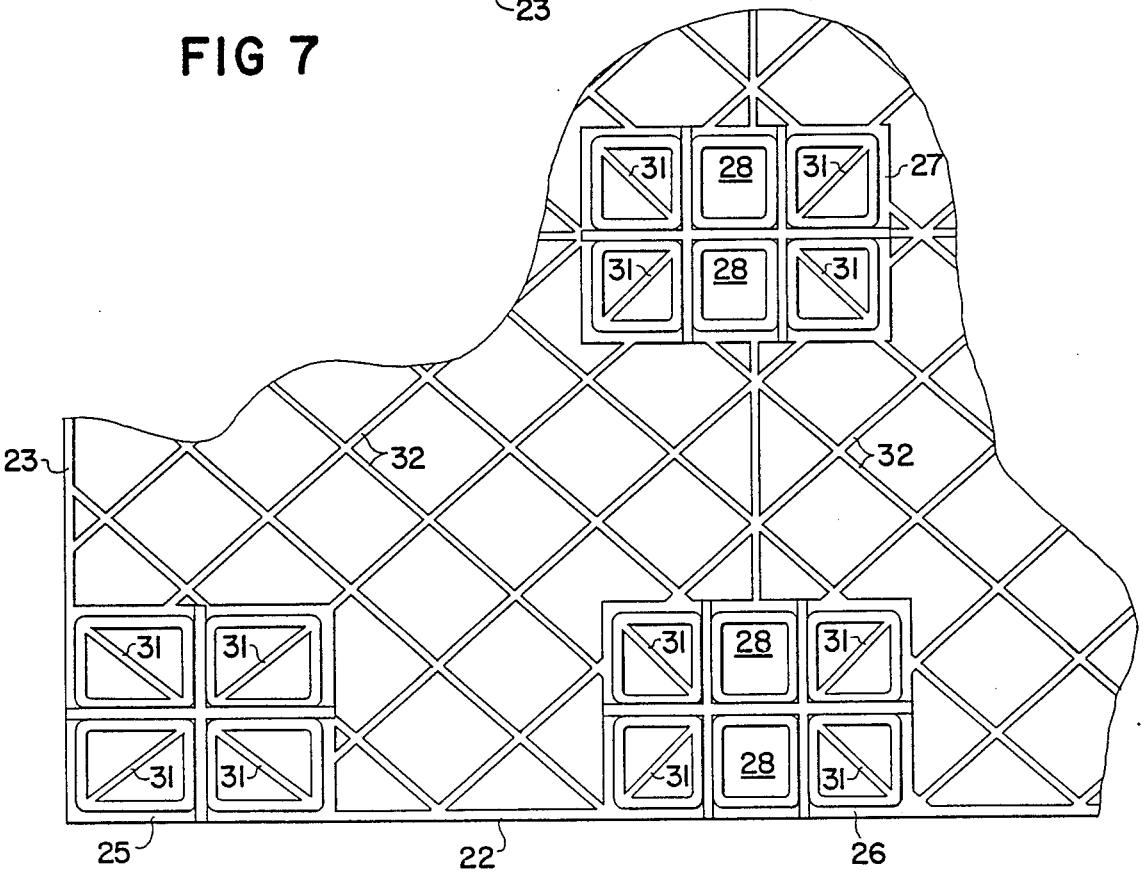
FIG. 6 is a partial bottom plan view of the pallet of FIG. 1.
Figure 8:
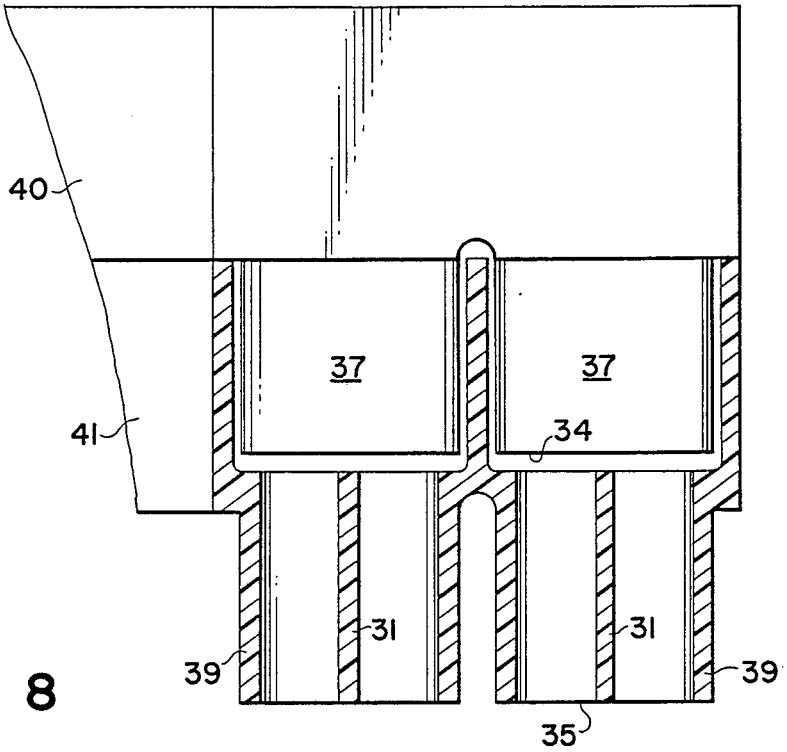
FIG. 8 is a cross sectional view taken along line 8—8 of FIG. 1 when two pallets are nested together.
Figure 9:
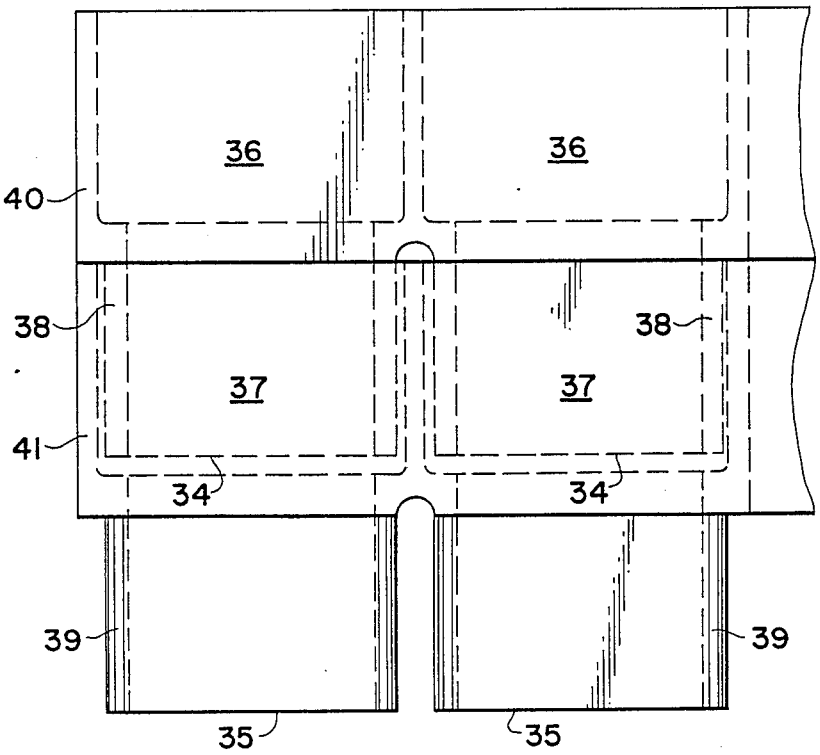
FIG. 9 is an enlarged side elevational view taken along line 9—9 of FIG. 1 when two pallets are nested together.
Figure 10:
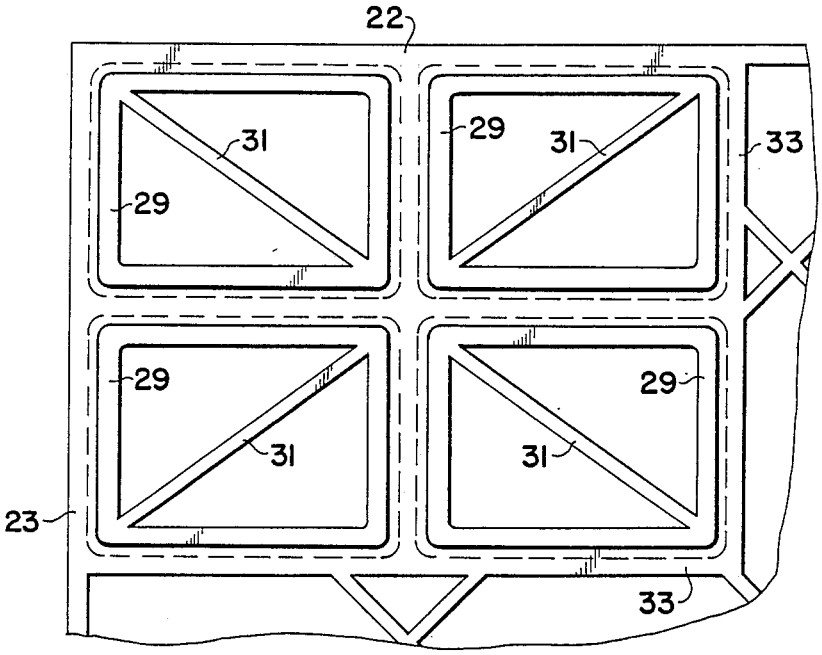
FIG. 10 is an enlarged bottom plan view taken along line 10—10 of FIG. 2.

In sections 26 and 27 which have six recesses 28 and legs 29, the stiffening web 31 may be eliminated particularly in the two middle legs 29 in that section, as shown in FIGS. 1 and 6. These webs 31 are for stiffness and strength and to adequately distribute the load on the pallet and therefore, there may be instances when such webs 31 are not considered necessary in some or in all of legs 29.

FIGS. 7–10 show how two pallets 40 and 41 nest together. Recesses 37 in lower pallet 41 receive internally in a loosely sliding telescopic arrangement legs 38 of upper pallet 40. Legs 39 of lower pallet 41 can rest on the ground and support all nested pallets above. These drawings show how corner sections 25 and side sections 26 having only four recesses and legs would nest, it being understood that the front and rear sections 26 and central section 27 similarly nest.

Figure 11:
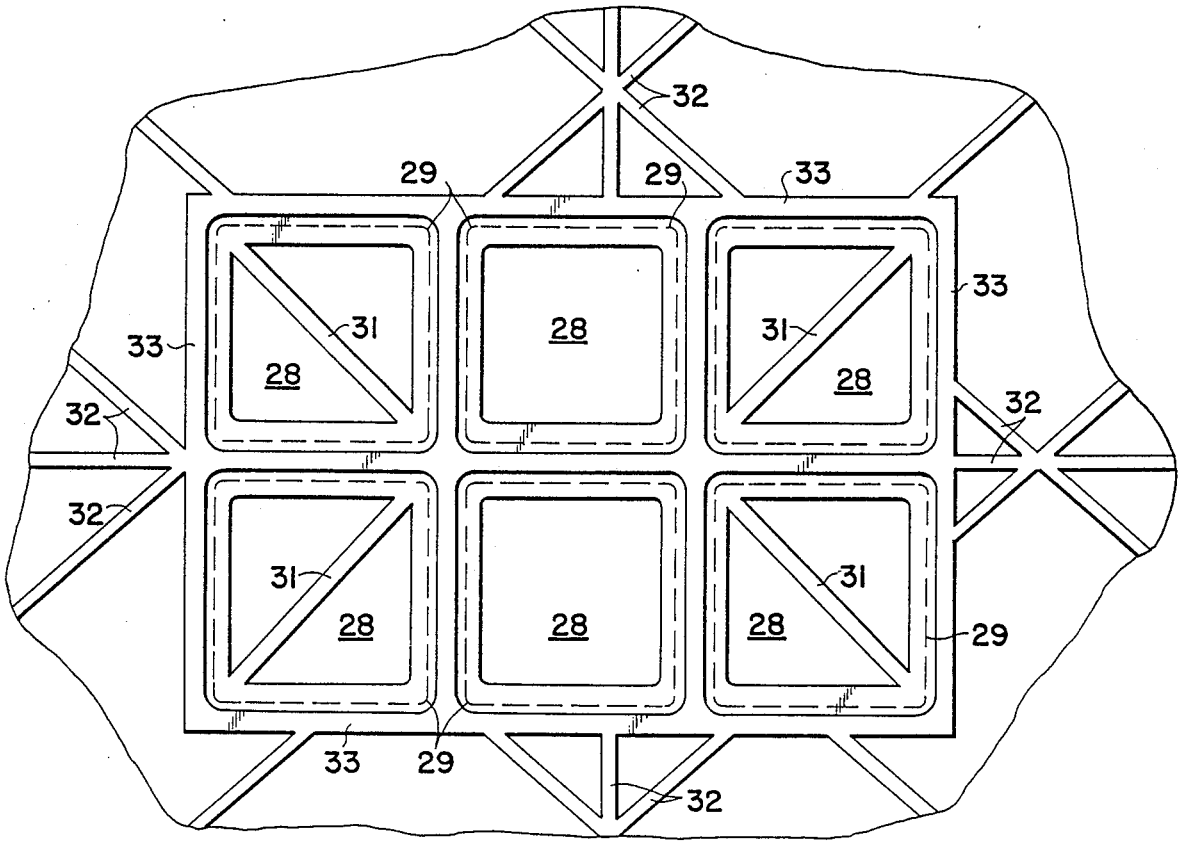
FIG. 11 is an enlarged top plan view of the middle offset portion of the pallet of FIG. 1.
Figure 12:
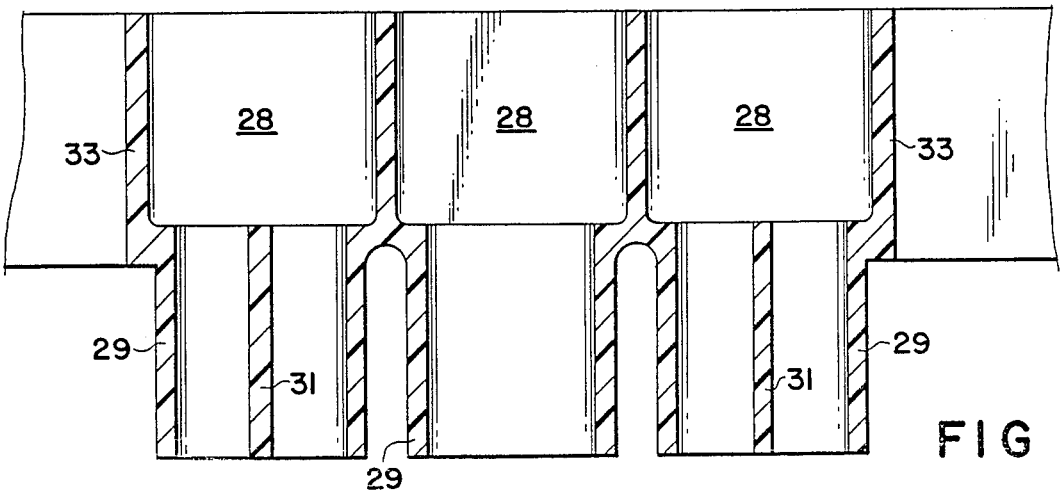
FIG. 12 is a cross sectional view taken along line 12—12 of FIG. 11.

FIGS. 11–12 show enlarged views of center section 27 or similar side sections 26 having six recesses and legs. The middle two legs 29 in each row of three does not contain a diagonal stiffening web 31 while all other legs do contain a web 31. As mentioned above there is no critical proportion of legs 29 that should or should not contain webs 31. For the most strength and stiffness each leg 29 should include a diagonal stiffening web 31, but they may be omitted if the legs are in the middle as shown.

Figure 13:
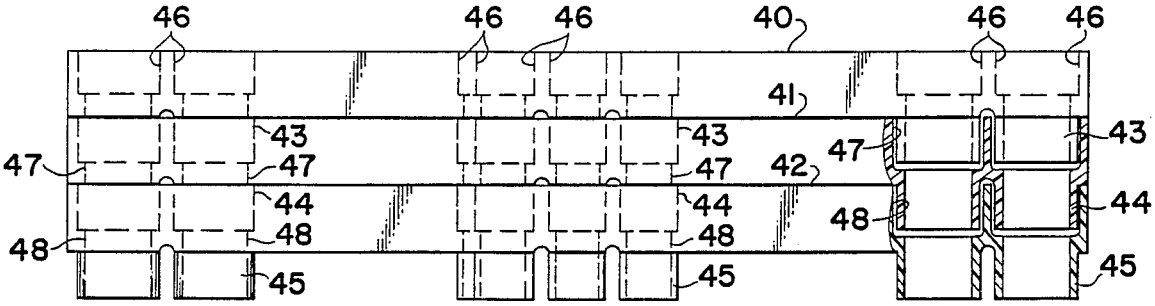
FIG. 13 is a front elevational view, partially in cross section, of three nested pallets of this invention.

In FIG. 13 there are three pallets shown in a nesting arrangement. Top pallet 40 nests with middle pallet 41, which, in turn, nests with bottom pallet 42. Legs 43 of top pallet 40 are inserted into recesses 47 of middle pallet 41. Legs 44 of middle pallet 41 are inserted into recesses 48 of bottom pallet 42. Legs 45 of bottom pallet 42 rest on floor level. Recesses 46 in top pallet 40 are available to receive legs of a fourth pallet to be added to the nesting stack of pallets.

Figure 14:
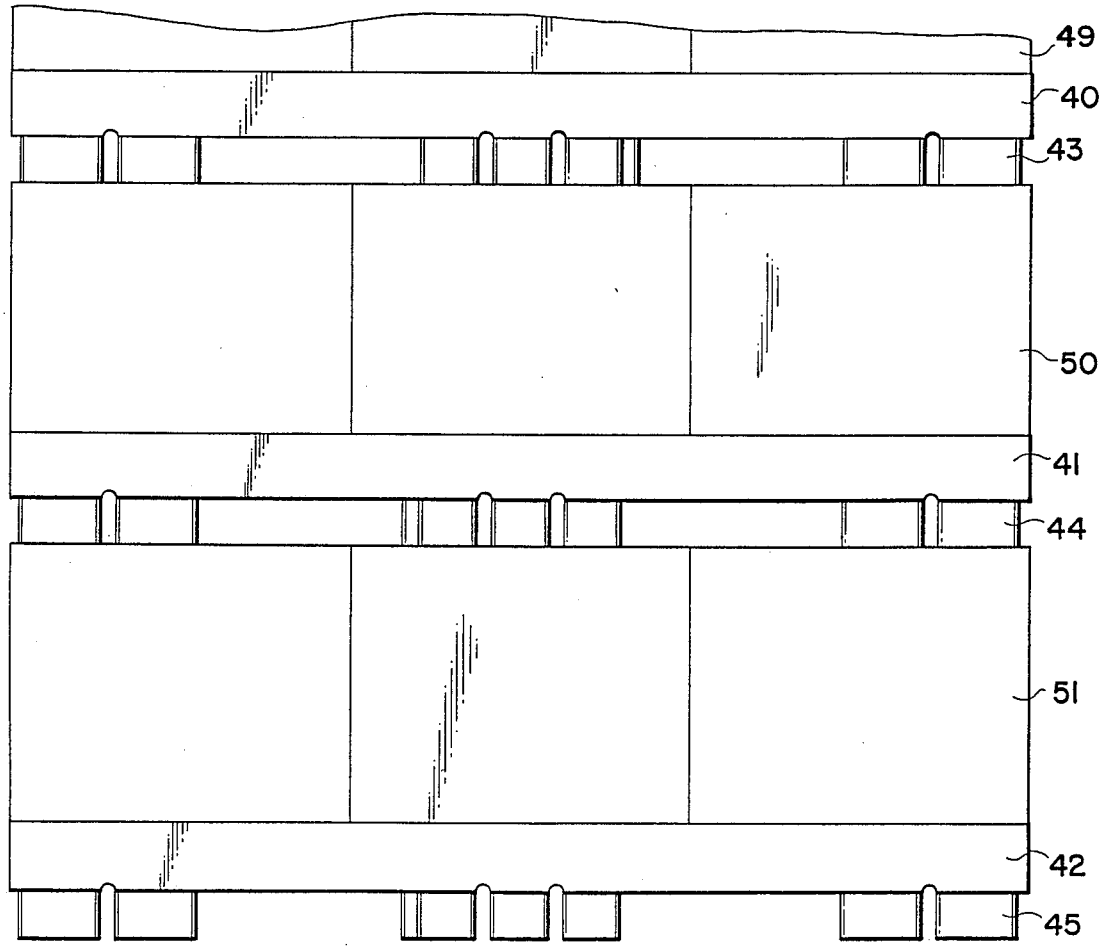
FIG. 14 is a front elevational view of three stacked pallets each with boxes or crates attached to respective pallets.

In FIG. 14 there is shown an arrangement normally used for storing pallets with contained goods in a warehouse, or the like. Upper pallet 40 is loaded with boxes 49 stacked on pallet 40 and perhaps held in that position by suitable straps, known in the art, around the boxes 49 and the body of pallet 40. Boxes 50 are similarly stacked on middle pallet 41. Boxes 51 are similarly stacked on lower pallet 42. Legs 43 of upper pallet 40 rest on top of boxes 50. Legs 44 of middle pallet 41 rest on the tops of boxes 51. Legs 45 of bottom pallet 42 rest on the floor or ground of the storage area. This would be the normal arrangement for stacking palletized goods in a warehouse. The height of the stack depends on how stable it is to rest legs 43 on boxes 50, etc. and also how high the fork lift truck can reach.

Figure 15:
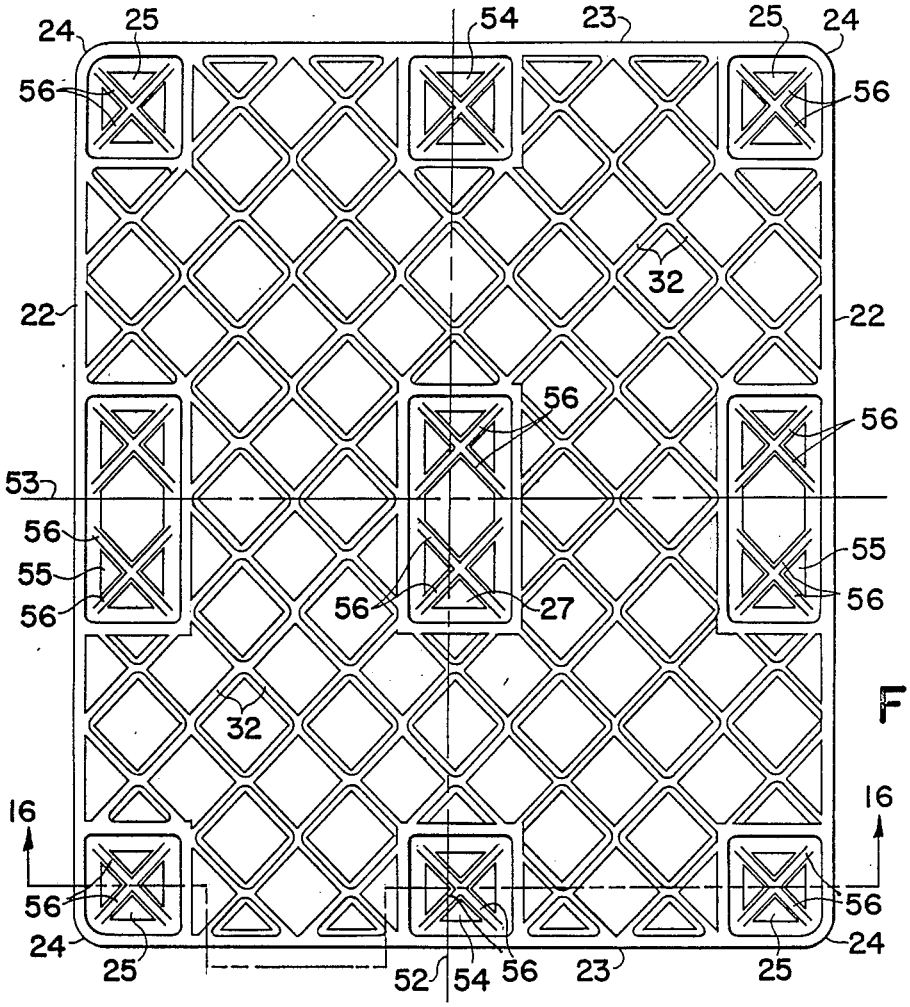
FIG. 15 is a top plan view of a preferred embodiment of a pallet of this invention.
Figure 16:
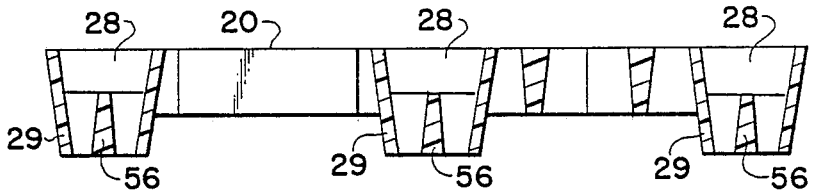
FIG. 16 is a cross sectional view of the pallet taken along line 16—16 of FIG. 15.

FIGS. 15 and 16 show a second and the preferred embodiment of the pallet of this invention. The general structure of the pallet is the same as that described above with respect to FIGS. 1–6. The difference is the structure and arrangement of the nine functional sections 25, 54 and 55. Each of the sections is made to be nonnestable with the corresponding section of another pallet when one pallet is oriented 180° with respect to the other. This is accomplished by offsetting with respect to centerlines 52 and 53 and/or sizing and/or shaping one section different from the other. For example, corner sections 25 are rectangular but sections 25 in opposite corners of the pallet are both rectangular with two long sides and two short sides. In one corner section 25 the long sides are parallel to centerline 52, but in the opposite corner section 25 the long sides are parallel to centerline 53. Therefore, when two pallets are oriented 180° out of phase, the leg 29 of upper pallet will not telescopically insert into the recess 28 of the lower pallet because the rectangular cross sections of leg 29 and recess 28 will have their long sides perpendicular to each other. Side sections 55 also have different dimensions parallel to centerlines 52 and 53 such that they will not mesh one into the other as they would be when adjacent pallets are oriented 180° different. Furthermore, sections 55 are both offset from centerline 53 so that legs 29 and recesses 28 will be displaced from each other when the orientation of two pallets are 180° apart. Center section 27 is offset from centerline 53 so that its legs 29 will not nest in its recesses 28 when the adjacent pallets are oriented 180° with respect to each other. This pallet of FIGS. 15 and 16 is preferred because of the different features of offsetting and of dimensions that assure the nonnesting of two pallets oriented differently. This is important in an automatic packaging and palleting machine where there should be no possibility of inadvertent catching of a leg in a recess when such pallets are stacked and are to be dispensed one at a time. Furthermore, this design provides stiffening means 56 in all projecting legs 29 to provide increased strength to resist breakage. It is also important that this design has less solid volume than the other design of FIGS. 1–6 and therefore is less expensive to manufacture and easier to mold from foamed plastic. For example, the design of FIGS. 1–6 requires about $\frac{3}{4}$ cubic foot of foam to fill the void in the mold while the design of FIGS. 15 and 16 only requires about $\frac{1}{2}$ cubic foot. All surfaces may be tapered to provide ease of removal from a mold. It can readily be appreciated that there are many other combinations of offsetting and varying of dimensions and shaping that will make two adjacent pallets nonnestable unless identically oriented, e.g., making some legs 29 round and some recesses angular so that nesting is impossible if the two different shapes meet.

Preferably the pallet of this invention is made by injection molding of a foamable plastic material, e.g., polyurethane, having a cellular internal structure that is light weight but strong, and have a smooth surface to permit the insertion and withdrawal of legs 29 freely into and out of recesses 28.

As hereinabove set forth, the design of FIGS. 15 and 16 requires less foam plastic material than the design of FIGS. 1–6 for the same size of pallet and apparently without a decrease in structural strength or load carrying ability for the pallets. While other materials may possibly be used, the weight and/or costs would make them prohibitive in practice.

It is to be noted that shapes of sections 25, 26, 27, 54 and 55 may be other than rectangular, e.g., round, elliptical, triangular, or a mixture of polygonal and arcuate shapes; it only being necessary to make like sections nestable or nonnestable depending on the orientation of two adjacent pallets. Sections and legs must, of course, be positioned so as to permit an unobstructed insertion of the tines of a fork lift truck from any side of the pallet and with the surface 20 and bottom surface 30 of legs 29 smoothly planar so as to slide easily over each other when stacked.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A rigid load carrying rectangular pallet formed of a molded synthetic plastic foam comprising a planar top loading surface, a bottom surface substantially parallel to said top surface, and four substantially vertical side walls depending downwardly from said top surface to said bottom surface and meeting in four right angle corners, a plurality of spaced geometrically shaped functional sections in said pallet having top surfaces coplanar with said top loading surface and vertical walls extending downwardly from said top loading surface to said bottom surface, four of said sections being in said four right angle corners, four other said sections being positioned along said side walls substantially midway between adjacent pairs of said four right angle corners, and the remainder of said sections being spaced away from said side walls and positioned to permit unobstructed insertion of the tines of a fork lift truck under said bottom surface from any side of said pallet, each of said sections having a recess extending downwardly from said top loading surface substantially to said bottom surface, each of said recesses having a tubular leg extending downwardly in vertical alignment with said recess from said bottom surface a distance not greater than the vertical height of said recess and being of a size and shape in outside dimensions of said leg as to fit freely telescopically into said recess, and the space between said four side walls, except for that occupied by said functional sections being filled with a plurality of spaced intersecting vertical parallel stiffening webs extending from one said side wall to another across all open portions of said space from said top loading surface to said bottom surface forming a honeycomb structure of enhanced stacking strength.

2. The pallet of claim 1 wherein said legs are internally structured with a diagonal stiffening web extending from a bottom of said recess to a bottom of said leg.

3. The pallet of claim 1 wherein there are nine said functional sections, eight of which are positioned as described in said corners and along said side walls midway between corners and the ninth being substantially centrally of said top loading surface and constituting said remainder of said sections.

4. The pallet of claim 1 wherein said functional sections, said recesses and said legs are rectangular in cross section in a direction taken parallel to said top loading surface.

5. The pallet of claim 1 wherein each said tubular leg includes a vertical stiffening web extending diagonally across and within said tubular leg from the bottom of said recess to the bottom of said tubular leg.

6. The pallet of claim 1 wherein each of said functional sections contains a plurality of said recesses and one said leg for each said recess.

7. The pallet of claim 1 wherein said remainder of said sections includes independent vertical walls spaced from said side walls of said pallet with all other said functional sections having a vertical wall common with one of said side walls of said pallet.

8. The pallet of claim 1 wherein said four side walls include two mutually parallel lengthwise side walls and two mutually parallel lateral walls, said lengthwise walls being longer than and perpendicular to said lateral walls.

9. The pallet of claim 8 wherein said four functional sections in said right angle corners and two of said others located on opposite sides of said pallet are of identical size and shape including four said recesses and four said tubular projections positioned in an arrangement of two rows of two recesses and projections in each row to form a rectangular shape in horizontal cross-section; and the remaining three said functional sections contain six of said recesses and six said tubular projections positioned in an arrangement of two rows of three recesses and projections in each row to form a rectangular shape in horizontal cross-section and being oriented in the same direction as the rectangular shape of said pallet with said rows being parallel to said lengthwise walls.

10. The pallet of claim 1 wherein at least one of said functional sections is offset in a direction parallel to one of said side walls sufficiently to permit two identical said pallets, when placed vertically one above the other, to nest with each said leg of one said pallet to telescopically slide into each said respective recess in the other said pallet when both said pallets are rotatively oriented in a horizontal plane identically with each other with said one pallet bottom surface being supported by said other pallet top surface; and, when one of said pallets is rotated 180° in a horizontal plane about an axis perpendicular to said top loading surface, the bottom of each said leg of the uppermost pallet rests on and is supported by said top loading surface.

11. The pallet of claim 10 wherein said four functional sections located on said corners are arranged into a first set of two identical sections and a second set of two identical sections, said sections of one set having legs incapable of a male-female connection with recesses of said other set, but capable of male-female connection with recesses of the same set.

12. A load carrying rectangular pallet comprising a base formed of a rigid, molded synthetic plastic foam and having a planar top loading surface, a bottom surface substantially parallel to said top surface, and four substantially vertical side walls depending downwardly from said top surface to said bottom surface and meeting in four right angle corners, a plurality of rectangularly shaped functional sections in said base having top surfaces coplanar with said loading surface and vertical walls extending downwardly from said top loading surface to said bottom surface, four of said sections being in said four right angle corners, four of said sections being positioned along said side walls substantially midway between adjacent pairs of said four right angle corners, and the remainder of said sections being spaced away from said side walls and positioned to permit unobstructed insertion of the tines of a fork lift truck under said bottom surface, each of said sections having at least one rectangular recess extending downwardly from said top loading surface substantially to said bottom surface, each of said recesses having a rectangular hollow tubular leg projecting downwardly from said base in vertical alignment with said recess from its said bottom surface a distance not greater than the vertical height of said recess, a diagonally positioned vertical stiffening web in said hollow of said leg extending between a bottom of respective recess and a bottom of said leg to provide increased load distributing surfaces to each said leg, said leg being of a size and shape in outside dimensions as to fit freely telescopically into said recess to permit stacking of two identical said pallets, and a plurality of spaced vertical intersecting stiffening webs positioned generally at 45° from said four side walls and extending across all open portions between adjacent said recesses from said top loading surface to said bottom surface, said intersecting webs forming a honeycomb structure between said top loading and bottom surfaces throughout said base between adjacent said recesses to provide enhanced load carrying strength throughout said base and distribute same to said legs.

13. The pallet of claim 12 wherein each said tubular leg includes a hollow and a vertical stiffening web extending diagonally across said hollow of said tubular leg between the bottom of said recess and the bottom of said tubular leg.

14. The pallet of claim 12 wherein each said tubular leg is shorter than the depth of each said recess whereby nested pallets are supported via bottom surface of an upper pallet contacting upper surface of a lower pallet.

15. The pallet of claim 12 wherein remainder of said sections includes independent vertical walls spaced from said side walls of said pallet with all other said functional sections having a vertical wall common with at least one of said side walls of said pallet.

16. The pallet of claim 12 wherein said four side walls include two mutually parallel lengthwise side walls and two mutually parallel lateral walls, said lengthwise walls being longer than and perpendicular to said lateral walls, at least one of said remainder of said sections being generally centrally located in said base, two of said other sections being located along said internal side walls are of identical size and shape and each including four said recesses and four said tubular legs positioned in an arrangement of two rows of two recesses and legs in each row to form a rectangular shape in horizontal cross-section; two of said other sections and said remainder of said sections including six of said recesses and six said tubular legs positioned in an arrangement of two rows of three recesses and legs in each row to form a rectangular shape in horizontal cross-section and being oriented in the same direction as the rectangular shape of said pallet with said rows being parallel to said lengthwise walls.

17. The pallet of claim 12 wherein at least one of said functional sections is offset in a direction parallel to one of said side walls sufficiently to permit nesting of two identical said pallets placed vertically one above the other with each said leg of the upper said pallet to telescopically readily slide into said respective recess in the lower said pallet when both said pallets are identically horizontally oriented, and to permit stacking by a 180° rotation of one said pallet about an axis perpendicular to said top loading surface such that the bottom of at least said one functional section of said upper pallet rests on said top loading surface.

18. The pallet of claim 12 wherein said four functional sections located in said corners are arranged into a first set of two identical sections and a second set of two identical sections, said sections of one set having legs incapable of a male-female connection with recesses of the other set, but capable of male-female connection with recesses of the same set whereby orientation of two identical said pallets in the same direction permits nesting therebetween and rotation of one of said pallets 180° about a vertical axis permits stacking therebetween.

19. A unitary load carrying rectangular pallet having a base and projecting legs all formed of a molded synthetic plastic foam having structural rigidity, said base having a planar top loading surface, a bottom surface substantially parallel to said top surface, two substantially vertical longitudinal side walls depending downwardly from said top surface to said bottom surface, two substantially vertical lateral side walls depending downwardly from said top surface to said bottom surface, said longitudinal and lateral side walls meeting in four right angle corners, said pallet having a longitudinal centerline parallel to said longitudinal side walls and a lateral centerline parallel to said lateral side walls, a plurality of spaced geometrically shaped functional sections in said pallet having top surfaces coplanar with said loading surface and vertical walls extending downwardly from said top loading surface to said bottom surface, four of said sections being in said four right angle corners, four other of said nine sections being positioned along said side walls midway between adjacent pairs of said four right angle corners, and at least one of said sections being spaced away from said side walls and positioned to permit unobstructed insertion of the tines of a fork lift truck under said bottom surface, each of said sections having a recess extending downwardly from said top loading surface substantially to said bottom surface, each of said recesses having respective said projecting leg extending downwardly in vertical alignment with said recess from said bottom surface a distance not greater than the vertical height of said recess and being of a size and shape in outside dimensions of said leg as to freely fit telescopically into corresponding said recess of an identical said pallet, said functional sections being arranged in positions nonsymmetrical about both said centerlines such that when said top surface of one pallet is oriented in the same direction with respect to the top surface of a superimposed second pallet the legs of said one pallet will telescopically engage the corresponding recesses of said second pallet with the bottom surface of said base of said one pallet being supported by the top surface of said base of said second pallet, and when said one pallet is rotated 180° about a vertical axis perpendicular to said top surface with respect to said second pallet said legs and said recesses will be misaligned and the bottom of said legs of said one pallet will be supported by the top surface of said second pallet, the space between said four side walls, except for that occupied by said sections being filled with a plurality of spaced intersecting vertical stiffening webs extending at an acute angle from one said side wall to another across all open portions of said space from said top loading surfaces to said bottom surface, said intersecting webs forming a honeycomb structure between said recesses for enhanced load carrying of said base.

20. The pallet of claim 19 wherein each said leg is tubular with a hollow therein, each said leg including a vertical stiffening web extending diagonally across the hollow thereof and extending from the bottom of said recess to the bottom of said leg for load distribution enhancement of said legs and to minimize breakage of such projecting legs from said base.

21. The pallet of claim 20 wherein said four and other four functional sections have at least one vertical wall common with one of said side walls of said base.

22. The pallet of claim 21 wherein said longitudinal side walls are longer than and perpendicular to said lateral walls and at least one functional section generally medially of said longitudinal side walls and centrally of said base are longer in the same direction as said longitudinal side walls.

23. The pallet of claim 22 wherein said four functional sections in said right angle corners and two of said other sections along said lateral side walls are of identical size and shape including four said recesses and four said tubular legs positioned in an arrangement of two rows of two recesses and legs in each row to form a rectangular shape and the other two of said other sections and said at least one section containing six of said recesses and six said legs positioned in an arrangement of two rows of three recesses and legs in each row to form a rectangular shape with said rows being parallel to said longitudinal centerline and said rectangular shapes of all said sections being oriented in the same direction as said rectangular pallet.

24. The pallet of claim 19 wherein said at least one functional section being adjacent the intersection of said centerline of said base and said centerline sufficiently to permit another identical pallet to said pallet, to be placed vertically above said pallet, to nest with its said legs telescopically into each said respective recess in said other pallet with said pallet and other pallet oriented horizontally in the same direction and one of said pallet or other pallet is rotated 180° about an axis perpendicular to said top loading surface, the bottom of said tubular projection of said at least one functional section of said other pallet will be supported on said top loading surface of said pallet.

25. The pallet of claim 19 wherein eight said functional sections in said corners and along said side walls are arranged in two sets of rectangular sections having recesses and legs of different sizes and shapes from the recesses and legs of the other set, whereby when two said pallets are superimposed on each other all legs of the uppermost pallet will nest with the corresponding recesses of the lowermost pallet, when both pallets are oriented in the same direction, but when one said pallet is rotated 180° horizontally about a vertical axis, the legs of the uppermost pallet will be supported by the upper surface of the lowermost pallet.

* * * * *